United States Patent [19]

Warnaka et al.

[11] Patent Number: 5,046,103

[45] Date of Patent: Sep. 3, 1991

[54] NOISE REDUCING SYSTEM FOR VOICE MICROPHONES

[75] Inventors: Glenn E. Warnaka; Lynn A. Poole, both of State College, Pa.

[73] Assignee: Applied Acoustic Research, Inc., State College, Pa.

[21] Appl. No.: 203,078

[22] Filed: Jun. 7, 1988

[51] Int. Cl.[5] ..... G10K 11/16

[52] U.S. Cl. ..... 381/71; 381/94

[58] Field of Search ..... 381/71, 73.1, 83, 93, 381/94

[56] References Cited

U.S. PATENT DOCUMENTS

| | | | |
|---|---|---|---|
| 2,983,790 | 5/1961 | Olson | 381/71 |
| 4,153,815 | 5/1979 | Chaplin et al. | 381/71 |
| 4,417,098 | 11/1983 | Chaplin et al. | 381/71 |
| 4,473,906 | 9/1984 | Warnaka et al. | 381/73.1 |
| 4,589,137 | 5/1986 | Miller | 381/71 |
| 4,649,505 | 3/1987 | Zinser, Jr. et al. | 381/71 |
| 4,653,102 | 3/1987 | Hansen | 381/94 |
| 4,654,871 | 3/1987 | Chaplin et al. | 381/94 |
| 4,658,426 | 4/1987 | Chabries et al. | 381/93 |
| 4,683,590 | 7/1987 | Miyoshi et al. | 381/71 |

FOREIGN PATENT DOCUMENTS 0205397 11/1983 Japan ..... 381/93

OTHER PUBLICATIONS

Seventh Annual Asilomar Conference on Circuits Systems and Computers, Pacific Grove, Calif., U.S.A., 7-9, Nov., 1977.

*Primary Examiner*—Forester W. Isen

*Attorney, Agent, or Firm*—Fleit, Jacobson, Cohn, Price, Holman & Stern

[57] ABSTRACT

A conventional voice microphone placed in non-critical spaced relation to a source of intelligible speech sound while exposed to an acoustical field of ambient noise, electrically transmits output signals attenuated under control of a signal processing controller to which a sampled input of noise signals is fed by a reference microphone exposed to the same acoustical noise field as the voice microphone for audio reproduction of the speech sound without background noise by programming of the controller.

3 Claims, 3 Drawing Sheets

NOISE REDUCING SYSTEM FOR VOICE MICROPHONES

BACKGROUND OF THE INVENTION

This invention relates to the attenuation of background noise in an acoustical field within which a voice microphone is immersed.

There are many applications in which a voice microphone is exposed to an acoustical field of ambient noise creating a problem in transmitting and reproducing intelligible speech sound. Intelligibility research has shown that speech is masked not only by noise of the same frequency but also noises at frequencies higher and lower than speech frequencies. The classical approach to such problem is to utilize a noise-cancelling microphone wherein the front and rear of the microphone diaphragm is exposed to the external noise field in order to cancel noise by virtue of equal pressures exerted on opposite sides of the diaphragm. Such noise cancelling arrangements for voice microphones, however, require microphone dimensions that are relatively small as compared to the wavelengths of the sound being handled. Because of the dimensional limitations involved in the manufacture of such microphones, all frequencies within the speech range cannot be effectively cancelled by the foregoing solution to the problem.

Presently available noise-cancelling microphones require that the microphone be held very close to the lips of a person from which the speech sound originates. Such closeness requirement arises because the pressure gradient established across the microphone diaphragm would otherwise effect cancellation of the speech signals themselves. One disadvantage of such "close talk" requirement of presently known noise cancelling microphones arises in the attachment of such microphone to a flight helmet or headset, for example, by means of a boom and cable introducing additional equipment weight. Other disadvantages of prior art noise cancelling microphones related to the "close talk" requirement involve the hygiene problem arising from the use of the microphone close to the mouth. The microphone with its mesh and cavity design often harbors and encourages the growth of harmful bacteria to which a person may be exposed because of the "close talk" requirement.

It is therefore an important object of the present invention to provide a noise cancelling microphone not limited to close placement relative to the mouth of a speaker. In accordance with such object, it is therefore an additional object of the present invention to provide a noise cancelling. microphone having greater flexibility insofar as placement and mounting is concerned without introducing the complexities of additional compensating equipment.

Yet another object of the present invention is to provide a noise cancelling system for a voice microphone of a conventional single stage type which is less complex and less massive, and may be readily placed or mounted in different environments such as helmets, oxygen masks, etc.

Still other objects of the present invention are to provide a noise cancelling system for voice microphones made useful for a variety of environments by appropriate programming of a sound enhancing acoustical data processor including narrow band voice encoding algorithms, for performance as a function of frequency and increased attenuation and for use in combination with conventional noise cancelling microphones.

SUMMARY OF THE INVENTION

In accordance with the present invention, it was discovered that a conventional type of primary voice microphone may be utilized for transmission of speech signals free of background noise without close spacing to a source of intelligible speech sound, such as the mouth of a person, while exposed to an acoustical field of ambient noise. The ambient noise picked up by the voice microphone is either acoustically attenuated by noise-cancelling sound emitted from an adjacent speaker or electronically attenuated during signal transmission from the voice microphone to its associated audio reproducing system. Acoustical attenuation is effected by drive of the noise cancelling speaker from a signal processing controller to which the voice microphone is connected together with a reference microphone located in spaced relationship to the voice microphone within the acoustical noise field, providing a sampled input to the controller of the ambient noise within the acoustical field to which the voice microphone is exposed. Thus, it was also discovered that the signal processing controller may be programmed in accordance with generally well known techniques utilizing a deterministic algorithm based on the propogational differences between the source of ambient noise and the source of intelligible speech sound.

In the case of the electronic noise cancellation embodiment of the invention, the signal processing controller, to which the sampled signal input from the reference microphone is supplied, is connected to one input of a summing amplifier having another input to which the voice microphone is connected providing the electronically attenuated output signal fed to the audio reproducing system with which the voice microphone is associated. Feedback from the output of such summing amplifier is furthermore applied to an error terminal of the signal processing controller programmed to provide the noise cancelling attenuation as aforementioned.

BRIEF DESCRIPTION OF THE DRAWING FIGURES

These and other objects and features of the present invention will become apparent from the following description taken in conjunction with the preferred embodiments thereof with reference to the accompanying drawings in which like parts or elements are denoted by like reference numerals throughout the several views of the drawings and wherein.

DETAILED DESCRIPTION OF PREFERRED EMBODIMENTS

Figure 1:
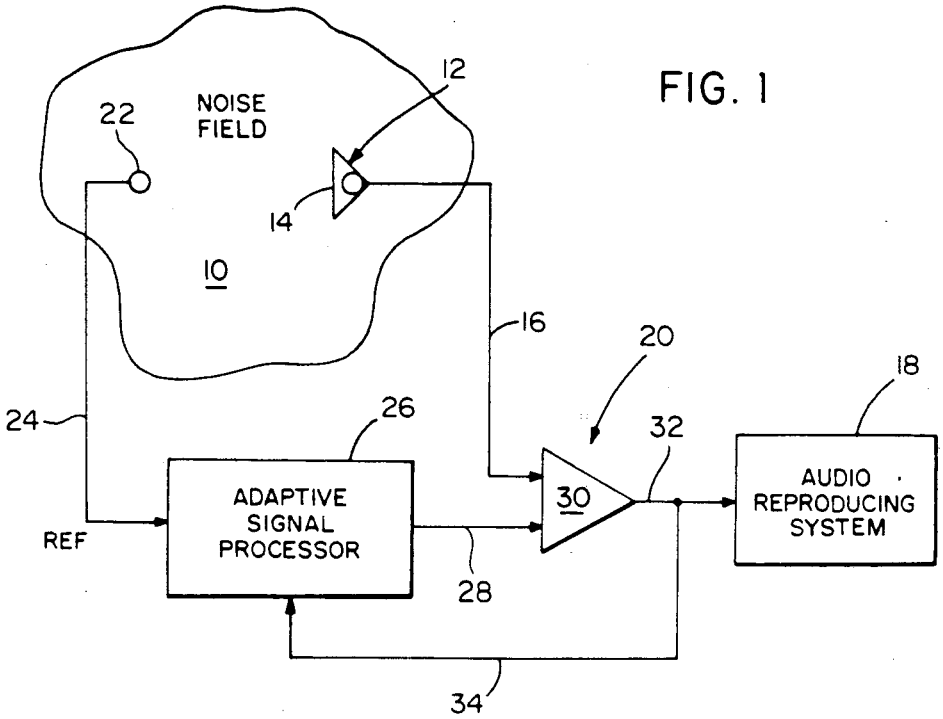
FIG. 1 is a schematic illustration and simplified circuit diagram illustrating the noise reducing system of the present invention in accordance with one embodiment.

Referring now to the drawings in detail, FIG. 1 schematically depicts an acoustical field of ambient noise generally referred to by reference numeral 10 within which a primary voice sensing microphone 12 is located, having a face portion 14 through which acoustical wave signals are sensed in a manner well known in the art. Accordingly, the voice microphone 12 is adapted to pick up at its face portion 14 intelligible speech sound from a spaced source located within the acoustical field 10, such as the speech sounds emitted by a person. Thus, the speech sound picked up by the voice microphone 12 is converted into an electrical signal conducted by signal line 16, such signal being ultimately fed to an audio reproducing system 18 of any suitable and well known type. The voice microphone 12 is, however, also operatively coupled by means of its signal line 16 to a noise reducing system 20 in accordance with the present invention. Associated with such noise reducing system 20 is another conventional type of microphone 22 also located within the acoustical noise field 10 in spaced relationship to the voice microphone 12 in order to detect the ambient noise and convert it into a reference signal conducted to and sampled by the noise reducing system 20 through reference signal line 24.

In accordance with one embodiment of the invention as depicted in FIG. 1, the noise reducing system 20 involves electronic cancellation of background noise by use of an adaptive signal processor 26 to which the reference signal line 24 is connected at one signal sampling input terminal. The output terminal of the processor 26 is connected by line 28 to one input of a summing amplifier 30 having another input to which the input signal line 16 from the voice microphone 12 is connected. The output signal line 32 of the summing amplifier 30 is connected to the audio reproducing system 18 aforementioned and by means of a feedback line 34 to an error input terminal of the signal processor 26. Adaptive signal processors of the type 26 depicted in FIG. 1 are already known as disclosed for example in our prior U.S. Pat. No. 4,473,906. Thus, the background noise within acoustical field 10 is detected by the reference microphone 22 to feed sampled inputs through line 24 to the processor 26 within which programmed operation occurs influenced by an error feedback input from line 34 to produce the noise attenuating output in line 28 fed to one of the inputs of the summing amplifier 30. The continuous input signal from the voice microphone 12 fed to the other input of amplifier 30 through line 16 is accordingly attenuated to produce an output in line 32 fed to the audio reproducing system 18 from which the intelligible speech sound picked up by the voice microphone 12 is reproduced with substantially no background noise.

Figure 2:
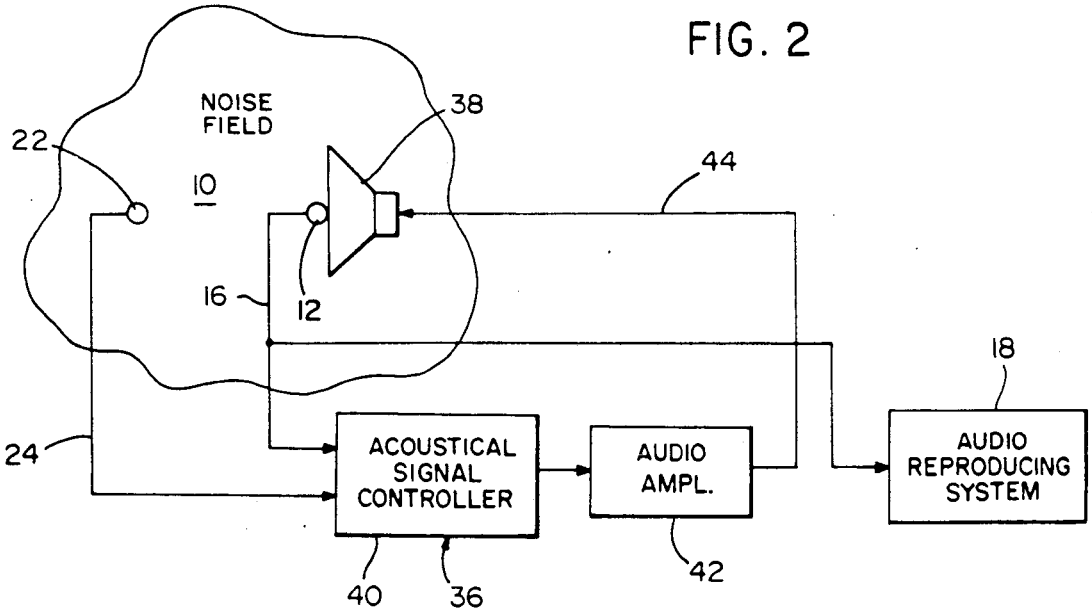
FIG. 2 is also a schematic illustration and circuit diagram of the noise cancelling system of the present invention in accordance with another embodiment.

FIG. 2 illustrates a noise cancelling system 36 associated with the voice microphone 12 and reference microphone 22 located within the noise field 10 as hereinbefore described, in accordance with another embodiment of the invention wherein noise reduction is acoustically effected. Toward that end, the face portion 14 of the voice microphone 12 is positioned adjacent the output diaphragm of an acoustical speaker 38. Both a continuous input signal in line 16 from the voice microphone 12 and a sampled reference signal from the microphone 22 in line 24 are fed through input terminals to an acoustical signal controller 40 associated with the noise reducing system 36. The output of the controller 40 is fed to an audio amplifier 42 which drives the speaker 38 through output line 44. Thus, the acoustical wave output from the speaker 38 attenuates the intelligible speech sound wave input to the voice microphone 12 under control of a sampled input from the microphone 22, and acoustical enhancement of the controller 40 so as to directly feed a signal from line 16 to the audio reproducing system from which the input speech sound is reproduced substantially free of background noise. The programming of the signal processing controller by noise attenuating algorithms as aforementioned in connection with the signal processor 26 of FIG. 1, involve techniques already known in the art as disclosed for example in U.S. Pat. No. 4,473,906 aforementioned.

Figure 3:
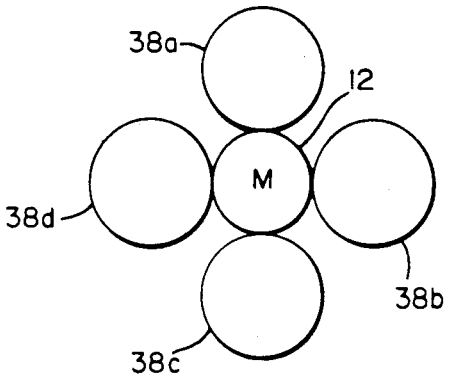
FIG. 3 is a somewhat schematic illustration of a particular arrangement of voice microphone and noise cancelling speakers in accordance with a particular embodiment of the invention.
Figure 4:
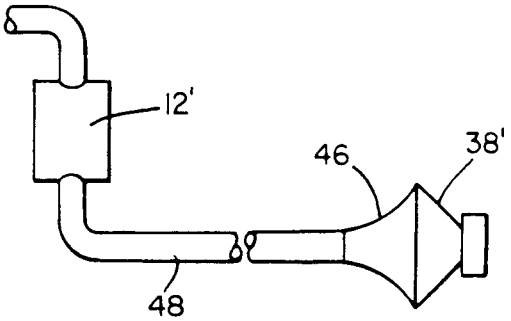
FIG. 4 is a somewhat simplified view of a voice microphone and noise cancelling speaker in accordance with another embodiment of the invention.

In accordance with the present invention, various arrangements of the voice microphone 12 and noise attenuating speaker 38 as schematically depicted in FIG. 2 may be utilized. FIG. 3 illustrates for example the voice microphone 12 positioned centrally and adjacent to the output diaphragms of four noise attenuating speakers 38A, 38B, 38C, and 38D. Accordingly, acoustical noise reducing attenuation is provided in all directions with respect to the microphone 12. According to other embodiments of the invention as depicted in FIG. 4, a voice microphone 12′ may be remotely spaced from one or more noise cancelling loudspeakers 38′. Each noise cancelling loudspeaker 38′ is operatively associated with the voice microphone 12′ by means of a reverse horn 46 and a wave guide tube 48.

Figure 5:
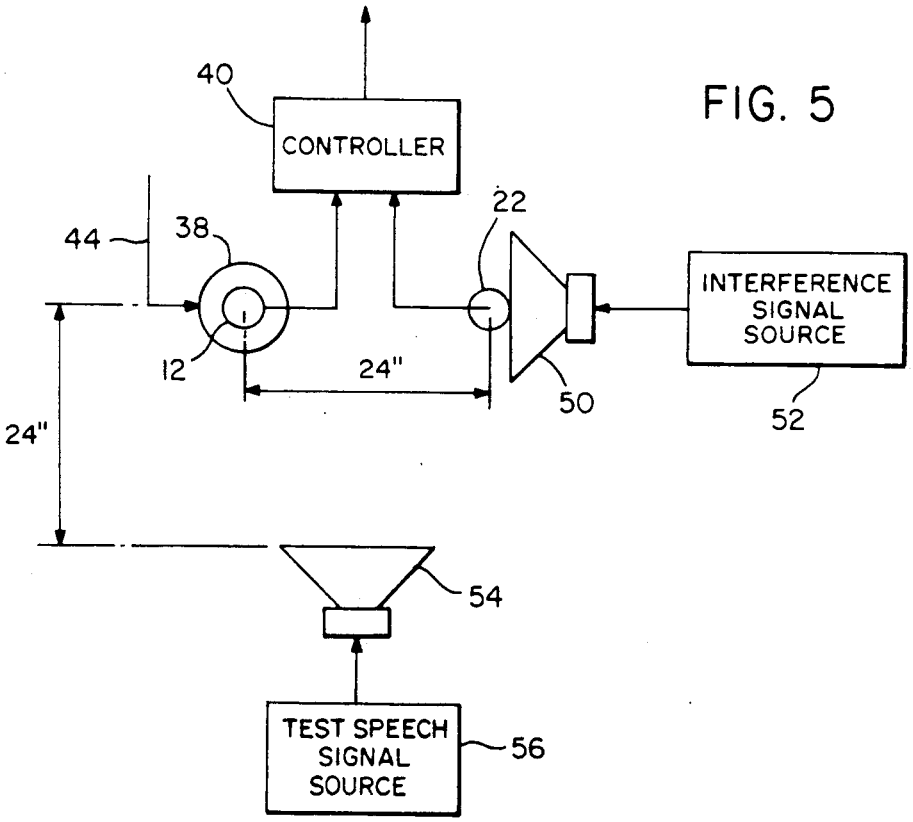
FIG. 5 is a schematic illustration and block diagram of one particular test arrangement through which the programming of the signal processing controller may be effected.
Figure 6:
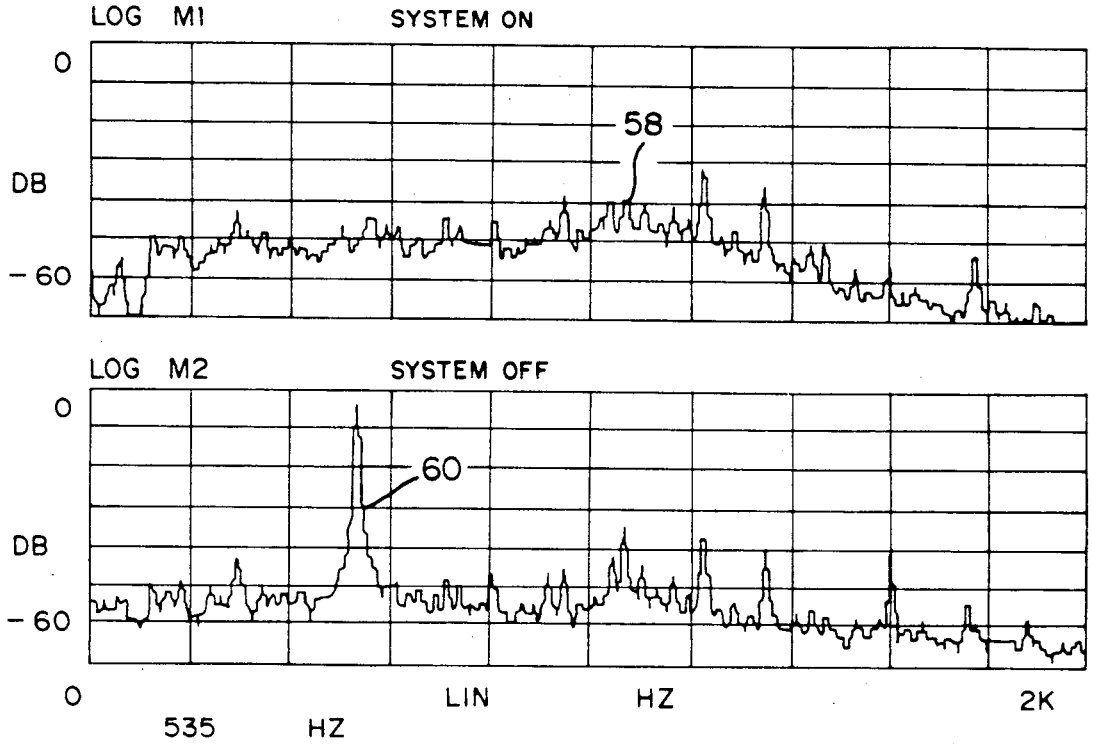
FIG. 6 is a comparative graphical illustration of acoustical signal characteristics corresponding to the embodiment of the invention illustrated in FIG. 1.

The electronic controller 26 or 40, respectively shown in FIGS. 1 and 2, is programmed in accordance with an adaptive algorithm as disclosed in our prior U.S. Pat. No. 4,473,906. One of the important discoveries of the present invention, as aforementioned, resides in the ability to develop such an algorithm for the signal processing controller based on the propogational differences between the background noise source and the intelligible speech source which is not limited to close spacing from the voice microphone 12. FIG. 5 illustrates a typical test arrangement made in accordance with the present invention from which a modified deterministic algorithm was developed in programming the signal processing controller 40 corresponding to the embodiment illustrated in FIG. 2. As shown in FIG. 5, the microphones 12 and 22 were spaced from each other by 24 inches within a background noise field established by a speaker 50 positioned adjacent to the reference microphone 22 and connected to an interference signal source 52 through which the speaker was driven. The voice microphone 12 exposed to the speaker generated acoustical noise field sampled by the microphone 22, also detects the intelligible speech sound generated by a speaker 54, the output diaphragm of which is spaced from the voice microphone 12 by 24 inches as shown in FIG. 5. Thus, the speaker 54 is connected to and driven by a test speech signal source 56. Based on the known characteristics of the background noise simulating output of the speaker 50 and the intelligible speech sound output of speaker 54, as well as the propogational distances between such sources and the microphones 12 and 22, it was found that a controller 40 programmed in accordance with the deterministic noise cancelling criteria disclosed in our prior U.S. Pat. No. 4,473,906, the background noise may be effectively attenuated to substantially cancel background noise from the intelligible speech sound reproduced from the voice microphone 12 through the audio reproducing system 18. Utilizing for example the test arrangement illustrated in FIG. 5 and a 500 Hz tone as the noise originating from the interference signal source 52 driving the noise generating speaker 50, such noise was effectively cancelled by a noise reducing output of the speaker 38, having its diaphragm located adjacent the voice microphone 12 as shown in FIG. 5, by an acoustical attenuating output of 40 to 60 db. The noise cancelling attribute of such acoustical attenuation is reflected by curve 58 in FIG. 6 measuring audio reproduction of the intelligible speech sound injected into the noise field by the speaker 54 connected to the test speech signal source 56 as shown in FIG. 5. The same audio reproduction of such speech source through the voice microphone 12 without acoustical attenuation is depicted by curve 60 in FIG. 6, which includes by comparison sharp peak portions not present in the attenuated sound curve 58.

Figure 7:
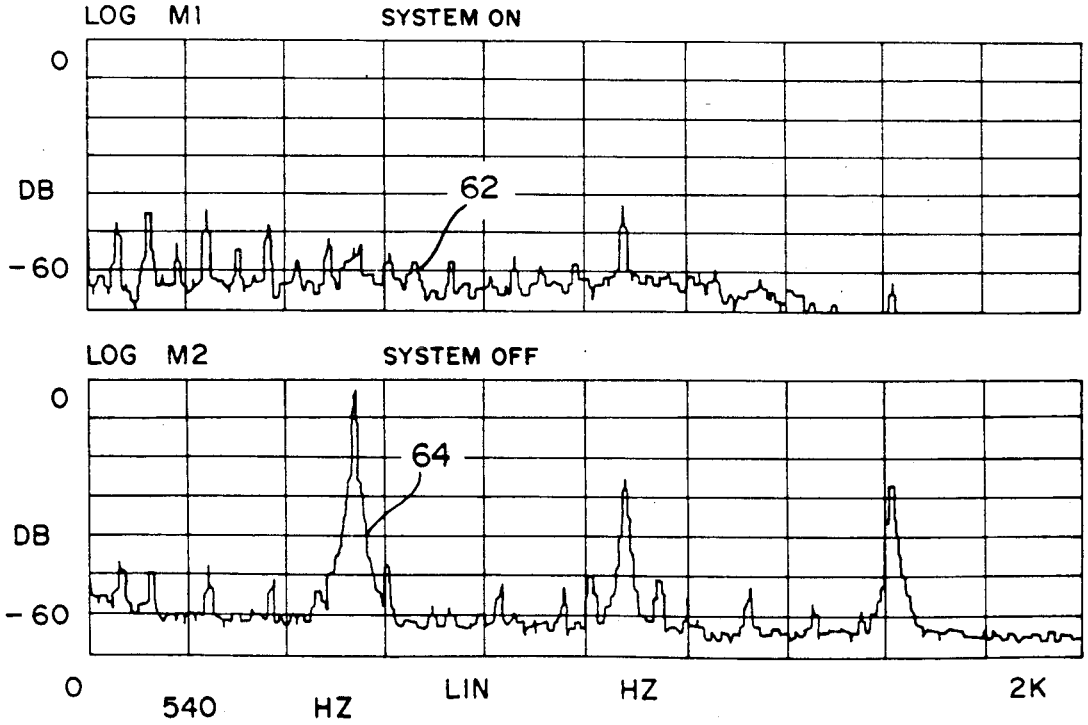
FIG. 7 is a comparative graphical illustration of acoustical signal characteristics corresponding to the embodiment of the invention illustrated in FIG. 2.

Utilizing the same arrangement as depicted in FIG. 5, programming adjustments and measurements were made in connection with an electronic attenuation system as depicted in FIG. 1 resulting in an attenuated signal curve 62 shown in FIG. 7 for comparison with a non-attenuated signal curve 64.

The same test arrangement as depicted in FIG. 5 and the same programming technique for the controller as hereinbefore described, were utilized to obtain comparable results in connection with different sources of ambient noises such as helicopter noise, turbo-prop noise, jet fighter noise, pink noise and noise characterized by a broad band harmonic series. Somewhat different sound attenuation ranges for the noise emitting speaker 50 was found necessary for the respective noise sources as shown in the following chart:

NOISE ATTENUATION CHART

| Noise Source | Attenuation Noise Range (db) |
|---|---|
| 100 Hz tone | 40–60 |
| 500 Hz tone | 40–60 |
| Broadband Harmonic Noise | 10–24 |
| Helicopter Noise | 10–20 |
| Turbo Prop Noise | 12–20 |
| Pink Noise | 10–17 |
| Jet Fighter Noise | 12–20 |

It will be apparent from the foregoing description that the placement of the voice microphone relative to the speech sound source is not limited to any close spacing and that such microphone may be of a single stage conventional type having less complexity, weight and volume as compared with noise cancelling microphones heretofore utilized. The voice microphone may accordingly be utilized in many different environments such as oxygen masks and helmets without restrictive placement or mounting complexity.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A noise attenuating system for attenuating ambient noise in an acoustical field into which intelligible speech sound is provided from a source located within said acoustical field, said system comprising:

primary sensing means positioned within said acoustical field for picking up said intelligible speech sound together with unwanted ambient noise and generating an output signal representative thereof;

reference sensing means positioned within said acoustical field for picking up at least said ambient noise and generating an output signal representative thereof;

signal processing means programmed for cancelling said ambient noise and receiving as input a data input signal and a feedback error input signal, the output of said reference sensing means being said data input signal, and for generating an output signal which is computed according to a modified deterministic algorithm;

summing means receiving as input the output signal of said primary sensing means and the output signal of said signal processing means, and for generating an output signal which is fed to said signal processing means as said feedback error input signal and corresponds to a noise attenuated output signal, said feedback error input signal being used by said signal processing means for adjusting said output signal to better effect the cancellation of said ambient noise.

2. A sound attenuating apparatus including: sound generating means for generating a cancelling sound introduced into an acoustical field of ambient noise, said cancelling sound for combination with and attenuation of said noise; sensing means for detecting said combination of the cancelling sound and said noise; and electronic controller means coupled to said sensing means and said sound generating means for activating and controlling said sound generating means to produce said cancelling sound, said electronic controller means employing a modified deterministic algorithm accommodating sound propagational differences between the noise and the intelligible speech sound injected into the acoustical field in spaced relation to the sensing means; said sensing means including a noise sampling microphone within the acoustical field and a voice microphone for reproducing the intelligible speech sound and the noise attenuated by said noise cancelling sound; said sound generating means including a noise cancelling speaker and audio amplifier means for coupling the electronic controller means to the noise cancelling speaker; said voice microphone being positioned adjacent the noise cancelling speaker and wave guide means being provided for acoustically coupling the voice microphone to the noise cancelling speaker.

3. In combination: a source from which intelligible speech sound is emitted within an acoustical field of ambient noise; a noise attenuating system including a voice microphone having a face portion exposed to said field spaced apart from the source, noise cancelling means positioned coupled to said voice microphone for cancelling the ambient noise picked up by the voice microphone, reference sensing means located in said field spaced from the voice microphone for detecting the ambient noise within said field and controller means connected to the reference sensing means for generating a noise cancelling signal varied in response to sampled detection of the ambient noise by the reference sensing means; signal responsive means connected to the noise attenuating system for reproduction of the speech sound detected by the voice microphone substantially free of said ambient noise; said signal responsive means including a noise cancelling speaker; and wherein wave guide means is provided for acoustically coupling the noise cancelling speaker to the voice microphone.

* * * * *